US009540901B2

(12) United States Patent
Sevre

(10) Patent No.: US 9,540,901 B2
(45) Date of Patent: Jan. 10, 2017

(54) RETRIEVABLE SWELLABLE PACKER

(71) Applicant: HALLIBURTON ENERGY SERVICES, INC., Houston, TX (US)

(72) Inventor: Alf K. Sevre, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/328,813

(22) Filed: Jul. 11, 2014

(65) Prior Publication Data

US 2014/0338890 A1 Nov. 20, 2014

Related U.S. Application Data

(63) Continuation of application No. 12/951,252, filed on Nov. 22, 2010, now Pat. No. 8,833,443.

(51) Int. Cl.

| | |
|---|---|
| ***E21B 29/00*** | (2006.01) |
| ***E21B 33/128*** | (2006.01) |
| ***E21B 33/12*** | (2006.01) |

(52) U.S. Cl.

CPC ..... *E21B 33/1285* (2013.01); *E21B 29/00* (2013.01); *E21B 33/1208* (2013.01)

(58) Field of Classification Search

CPC ... E21B 33/1285; E21B 33/1208; E21B 29/00
See application file for complete search history.

(56) References Cited

U.S. PATENT DOCUMENTS

| | | | | |
|---|---|---|---|---|
| 3,918,523 | A * | 11/1975 | Stuber | E21B 33/14 166/242.1 |
| 4,634,314 | A | 1/1987 | Pierce | |
| 5,479,986 | A | 1/1996 | Gano et al. | |
| 5,685,372 | A | 11/1997 | Gano | |
| 5,765,641 | A | 6/1998 | Shy et al. | |
| 6,006,671 | A | 12/1999 | Yunan | |
| 6,026,903 | A | 2/2000 | Shy et al. | |

(Continued)

FOREIGN PATENT DOCUMENTS

| | | |
|---|---|---|
| EP | 0009315 A1 | 4/1980 |
| EP | 2145076 | 1/2010 |

(Continued)

OTHER PUBLICATIONS

Search Report issued Jun. 26, 2012 for International Application No. PCT/US2011/060787, 5 pages.

(Continued)

*Primary Examiner* — David Bagnell
*Assistant Examiner* — Ronald Runyan
(74) *Attorney, Agent, or Firm* — Locke Lord LLP

(57) ABSTRACT

A well tool can include a swellable material, and a degradable material which supports the swellable material, but which degrades in response to contact with a selected fluid in a well. A packer for use in a subterranean well can include a swellable material, and a degradable material which supports the swellable material. A method of unsetting a packer in a subterranean well can include the steps of, after the packer has been set in the well, exposing a degradable material of the packer to a selected fluid, thereby degrading the degradable material, and a seal element of the packer being unsupported by the degradable material in response to the exposing step.

20 Claims, 4 Drawing Sheets

(56) References Cited

U.S. PATENT DOCUMENTS

| | | | | |
|---|---|---|---|---|
| 6,220,350 | B1 | 4/2001 | Brothers et al. | |
| 6,706,348 | B2 | 3/2004 | Quigley et al. | |
| 6,818,594 | B1 * | 11/2004 | Freeman | C09K 8/536 166/300 |
| 6,857,452 | B2 | 2/2005 | Quigley et al. | |
| 6,896,058 | B2 | 5/2005 | Munoz, Jr. et al. | |
| 7,000,680 | B2 | 2/2006 | Kurokawa et al. | |
| 7,093,664 | B2 | 8/2006 | Todd et al. | |
| 7,121,342 | B2 | 10/2006 | Vinegar et al. | |
| 7,353,879 | B2 | 4/2008 | Todd et al. | |
| 7,510,000 | B2 | 3/2009 | Pastor-Sanz et al. | |
| 7,546,873 | B2 | 6/2009 | Kim et al. | |
| 7,661,481 | B2 | 2/2010 | Todd et al. | |
| 7,699,101 | B2 | 4/2010 | Fripp et al. | |
| 7,789,152 | B2 | 9/2010 | Langeslag | |
| 8,430,174 | B2 | 4/2013 | Holderman et al. | |
| 2004/0231845 | A1 | 11/2004 | Cooke, Jr. | |
| 2005/0205266 | A1 | 9/2005 | Todd et al. | |
| 2005/0274524 | A1 | 12/2005 | Silguero | |
| 2006/0219407 | A1 | 10/2006 | Livingstone | |
| 2006/0275563 | A1 | 12/2006 | Duffy | |
| 2006/0276345 | A1 | 12/2006 | Todd et al. | |
| 2007/0074873 | A1 | 4/2007 | McKeachnie et al. | |
| 2007/0221387 | A1 | 9/2007 | Levy | |
| 2007/0277979 | A1 * | 12/2007 | Todd | E21B 33/12 166/287 |
| 2008/0066923 | A1 | 3/2008 | Xu | |
| 2008/0066924 | A1 | 3/2008 | Xu | |
| 2008/0084106 | A1 | 4/2008 | Marathe et al. | |
| 2008/0135249 | A1 | 6/2008 | Fripp et al. | |
| 2008/0149351 | A1 | 6/2008 | Marya et al. | |
| 2008/0277109 | A1 | 11/2008 | Vaidya | |
| 2008/0305326 | A1 | 12/2008 | Gavel et al. | |
| 2009/0084539 | A1 | 4/2009 | Duan et al. | |
| 2009/0283271 | A1 | 11/2009 | Langeslag | |
| 2010/0089565 | A1 | 4/2010 | Duan et al. | |
| 2010/0200235 | A1 | 8/2010 | Luo et al. | |
| 2010/0243269 | A1 | 9/2010 | Solhaug et al. | |
| 2011/0088901 | A1 | 4/2011 | Watters et al. | |
| 2011/0247833 | A1 | 10/2011 | Todd et al. | |
| 2012/0061102 | A1 | 3/2012 | Holderman et al. | |
| 2012/0125630 | A1 | 5/2012 | Sevre | |
| 2012/0160478 | A1 | 6/2012 | Todd et al. | |

FOREIGN PATENT DOCUMENTS

| | | | |
|---|---|---|---|
| GB | 2432377 | A | 5/2007 |
| WO | 2008/139132 | A1 | 11/2008 |

OTHER PUBLICATIONS

Written Opinion issued Jun. 26, 2012 for International Application No. PCT/US2011/060787, 4 pages.
GCC Examination Report issued Oct. 14, 2014 for GCC Patent Application No. 2011-19804, 3 pages.
A.C. Albertsson, "Advances in Polymer Science" vol. 157 entitled "Degradable Aliphatic Polyesters," Springer-Verlag Berlin Heidelberg publication, dated 2002.
Halliburton, Luke Holderman; Activiation Screen, Defensive Publication; Dec. 14, 2009; 3 pages.
U.S. Appl. No. 12/554,035, filed Sep. 4, 2009; 36 pages.
Halliburton, Completion Tools; Mirage® Disappearing Plug and Autofill Sub; Product Brochure H00093; Aug. 2005; 2 pages.
Halliburton, Easywell; Reliable Zonal Isolation; H05794; dated Sep. 2009; 6 pages.
Halliburton, Easywell; Swellpacker® Lite II Isolation System; H06917; Dec. 2009; 2 pages.
International Search Report with Written Opinion issued Dec. 12, 2011 for PCT Patent Application No. PCT/US11/031242, 11 pages.
Office Action issued Jul. 20, 2012 for U.S. Appl. No. 12/758,781, 32 pages.
Office Action issued Jul. 23, 2012 for U.S. Appl. No. 13/406,359, 27 pages.
Office Action issued Nov. 7, 2012 for U.S. Appl. No. 13/406,359, 25 pages.
Office Action issued Nov. 8, 2012 for U.S. Appl. No. 12/879,665, 23 pages.
Office Action issued Nov. 23, 2012 for U.S. Appl. No. 12/758,781, 20 pages.
Advisory Action issued Jan. 16, 2013 for U.S. Appl. No. 13/406,359, 3 pages.
Office Action issued Nov. 6, 2012 for U.S. Appl. No. 12/951,252, 26 pages.
Office Action issued May 17, 2012 for U.S. Appl. No. 12/951,252, 25 pages.
Office Action issued Oct. 29, 2013 for U.S. Appl. No. 12/951,252, 13 pages.
Nov. 30, 2015 Extended European Search Report.

* cited by examiner

RETRIEVABLE SWELLABLE PACKER

CROSS-REFERENCE TO RELATED APPLICATION

The present application is a continuation of U.S. application Ser. No. 12/951,252 filed on 22 Nov. 2010. The entire disclosure of this prior application is incorporated herein by this reference.

BACKGROUND

This disclosure relates generally to equipment utilized and operations performed in conjunction with a subterranean well and, in an example described below, more particularly provides a retrievable swellable packer.

It is known to use a swellable seal element on a packer for sealing off an annulus in a well. During or after installation of the packer in the well, a certain fluid is placed in contact with a swellable material, causing the material to increase in volume and thereby extend the seal element into sealing contact with a structure (such as, a casing, tubing, wellbore, etc.).

However, such packers have not been conveniently retrievable from wells in the past. The seal element is designed to resist degradation in the well environment, and so it is difficult to devise a means of releasing the seal element from its contact with the structure in the well.

Therefore, it will be appreciated that improvements are needed in the art. Such improvements would preferably allow for convenient retrieval of a swellable packer from a well after having been set in the well, but the improvements may be useful in other applications, as well.

SUMMARY

In the disclosure below, a well tool and associated methods are provided which bring improvements to the art of well tool actuation. One example is described below in which a swollen packer seal element is released from gripping engagement with a well structure. Another example is described below in which a swellable material of a well tool is first swollen while being supported by a degradable material, and then the degradable material is degraded in response to contact with a particular fluid.

In one aspect, a packer for use in a subterranean well can include a swellable material and a degradable material which supports the swellable material.

In another aspect, a method of unsetting a packer in a subterranean well can include the steps of, after the packer has been set in the well, exposing a degradable material of the packer to a selected fluid, thereby degrading the degradable material; and a seal element of the packer being unsupported by the degradable material in response to the exposing step.

In yet another aspect, a well tool is described which can include a swellable material and a degradable material which supports the swellable material, but which degrades in response to contact with a selected fluid in a well.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
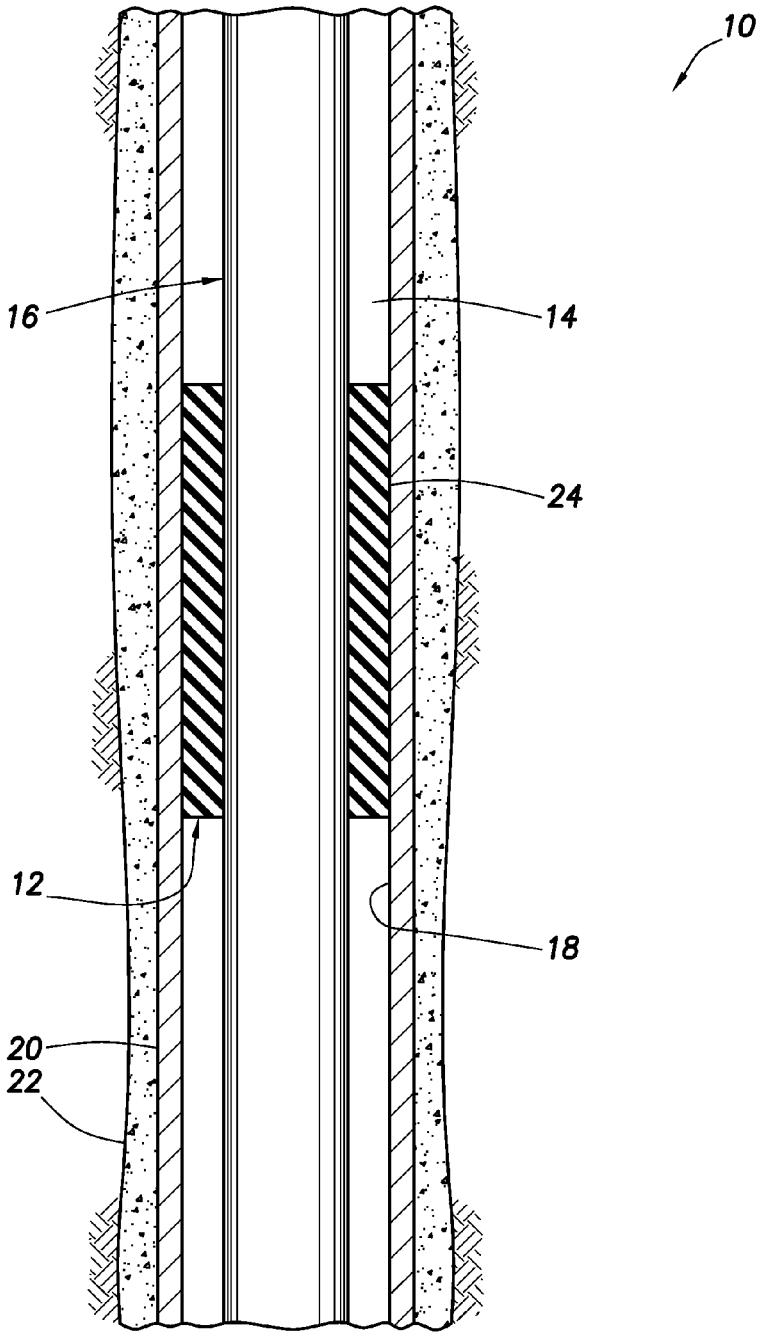
FIG. 1 is a schematic partially cross-sectional view of a well system and associated method which can embody principles of the present disclosure.

Representatively illustrated in FIG. 1 is a well system 10 and associated method which can embody principles of this disclosure. In the well system 10, a well tool 12 is used to seal off an annulus 14 formed between a tubular string 16 and a wellbore 18. In the example of FIG. 1, the wellbore 18 is lined with casing 20 and cement 22, but in other examples, the wellbore could be uncased or open hole.

The well tool 12 is representatively of the type known to those skilled in the art as a packer, but other types of well tools can incorporate the principles of this disclosure. For example, valves, well screens, latches, hangers, and other types of well tools can benefit from the principles described below.

In the FIG. 1 example, a seal element 24 of the well tool 12 is extended radially outward into sealing contact with the wellbore 18 to seal off the annulus 14. This radial extension of the seal element 24 can be due to swelling of a swellable material in response to contact with a selected fluid in the well.

The term "swell" and similar terms (such as "swellable") are used herein to indicate an increase in volume of a swellable material. Typically, this increase in volume is due to incorporation of molecular components of the activating agent into the swellable material itself, but other swelling mechanisms or techniques may be used, if desired. Note that swelling is not the same as expanding, although a seal material may expand as a result of swelling.

For example, in some conventional packers, a seal element may be expanded radially outward by longitudinally compressing the seal element, or by inflating the seal element. In each of these cases, the seal element is expanded without any increase in volume of the seal material of which the seal element is made. Thus, in these conventional packers, the seal element expands, but does not swell.

The activating agent which causes swelling of the swellable material is in this example preferably a hydrocarbon fluid (such as oil or gas). In the well system 10, the swellable material swells when the fluid comprises the activating agent (e.g., when the fluid enters the wellbore 18 from a formation surrounding the wellbore, when the fluid is circulated to the well tool 12, when the fluid is released from a chamber carried with the well tool, etc.). In response, the seal element 24 seals off the annulus 14 and applies a gripping force to the wellbore 18.

The activating agent which causes swelling of the swellable material could be comprised in any type of fluid. The activating agent could be naturally present in the well, or it could be conveyed with the well tool 12, conveyed separately or flowed into contact with the swellable material in the well when desired. Any manner of contacting the activating agent with the swellable material may be used in keeping with the principles of this disclosure.

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367 and 7,059,415, and in U.S. Published Application No. 2004-0020662, the entire disclosures of which are incorporated herein by this reference.

As another alternative, the swellable material may have a substantial portion of cavities therein which are compressed or collapsed at the surface condition. Then, after being placed in the well at a higher pressure, the material is expanded by the cavities filling with fluid.

This type of apparatus and method might be used where it is desired to expand the swellable material in the presence of gas rather than oil or water. A suitable swellable material is described in U.S. Published Application No. 2007-0257405, the entire disclosure of which is incorporated herein by this reference.

Preferably, the swellable material used in the well tool 12 swells by diffusion of hydrocarbons into the swellable material, or in the case of a water swellable material, by the water being absorbed by a super-absorbent material (such as cellulose, clay, etc.) and/or through osmotic activity with a salt-like material. Hydrocarbon-, water- and gas-swellable materials may be combined, if desired.

It should, thus, be clearly understood that any swellable material which swells when contacted by a predetermined activating agent may be used in keeping with the principles of this disclosure. The swellable material could also swell in response to contact with any of multiple activating agents. For example, the swellable material could swell when contacted by hydrocarbon fluid, or when contacted by water.

In conventional packers, the gripping force applied by the seal element 24 to the wellbore 18 after the swellable material is swollen cannot be readily relieved or reduced, and so it is extremely difficult to retrieve from the well. However, the present inventor has conceived of a way to relieve or reduce this gripping force, so that the well tool 12 can be conveniently retrieved from the well.

Figure 2:
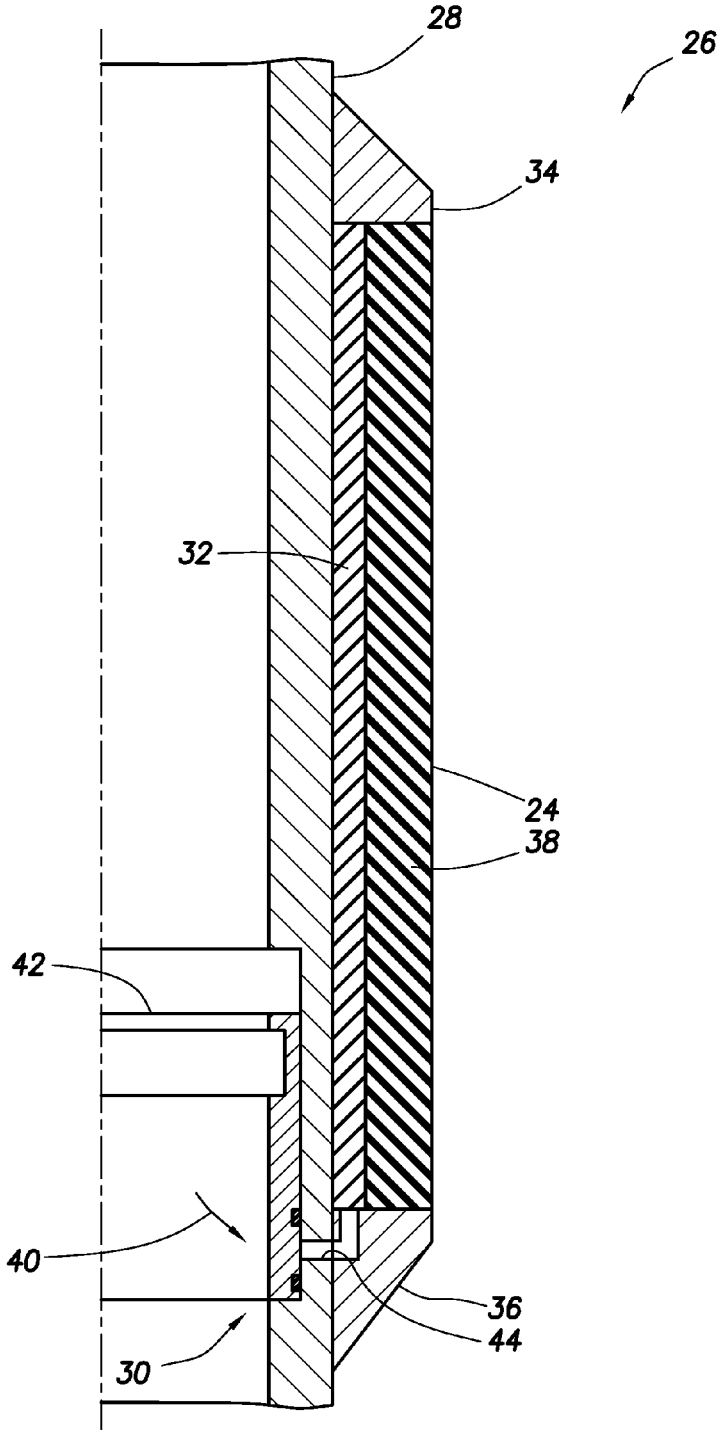
FIG. 2 is an enlarged scale schematic cross-sectional view of a packer which may be used in the well system of FIG. 1.

Referring additionally now to FIG. 2, an example of a packer 26 which may be used for the well tool 12 in the well system 10 of FIG. 1 is representatively illustrated. Of course, the packer 26 may be used in any other well system in keeping with the principles of this disclosure.

The packer 26 includes the seal element 24, a generally tubular mandrel 28, a valve 30, a degradable material 32 and end rings 34, 36. The seal element 24 preferably comprises a swellable material 38 which swells in response to contact with a certain fluid in a well, as discussed above.

The mandrel 28 is preferably provided with end connections (not shown) for interconnecting the packer 26 in the tubular string 16. The end rings 34, 36 longitudinally contain the seal element 24 and degradable material 32 on the mandrel 28.

Note that the degradable material 32 radially outwardly supports the seal element 24, in this example spacing the seal element radially away from the mandrel 28. However, when the degradable material 32 is degraded (as described more fully below), the seal element 24 will no longer be supported by the degradable material.

The valve 30 is used to selectively admit fluid 40 into contact with the degradable material 32. In this example, the valve 30 includes a slidable sleeve 42 which can be shifted upward to open a passage 44, and thereby provide fluid communication between the degradable material 32 and an interior of the mandrel 28.

Other types of valves (ball valves, rupture disks, electrically operated valves, etc.) may be used, if desired. In addition, it is not necessary for the fluid 40 to be in the interior of the mandrel 28 prior to contacting the degradable material 32, since the fluid could instead be exterior to the mandrel, contained in a chamber, or otherwise positioned prior to contacting the degradable material.

Preferably, the degradable material 32 is of a type which degrades in response to contact with the fluid 40, which preferably comprises water. However, other types of degradable materials and other types of fluids may be used, if desired.

In one example, the degradable material 32 comprises sodium and/or potassium, which oxidize in the presence of water. The degradable material 32 could also comprise an oxygen source, such as a peroxide in sealed capsules, so that an abundance of oxygen is available when the material is oxidized.

In another example, the degradable material 32 comprises a dissolvable material. Suitable dissolvable materials could include polyacrylic acid, polylactic acid, etc.

In another example, the degradable material 32 comprises an anhydrous boron compound which hydrates and dissolves in the presence of an aqueous fluid. Such anhydrous boron compounds include, but are not limited to, anhydrous boric oxide and anhydrous sodium borate.

Preferably, the anhydrous boron compound is initially provided as a granular material. As used herein, the term "granular" includes, but is not limited to, powdered and other fine-grained materials.

As an example, the granular material comprising the anhydrous boron compound is preferably placed in a graphite crucible, the crucible is placed in a furnace, and the material is heated to approximately 1000 degrees Celsius. The material is maintained at approximately 1000 degrees Celsius for about an hour, after which the material is allowed to slowly cool to ambient temperature with the furnace heat turned off. As a result, the material becomes a solid mass comprising the anhydrous boron compound.

Such a solid mass (and resulting structure) comprising the anhydrous boron compound will preferably have a compressive strength of about 165 MPa, a Young's modulus of about 6.09E+04 MPa, a Poisson's ratio of about 0.264, and a melting point of about 742 degrees Celsius. This compares favorably with common aluminum alloys, but the anhydrous boron compound additionally has the desirable property of being dissolvable in an aqueous fluid.

For example, a structure formed of a solid mass of an anhydrous boron compound can be dissolved in water in a matter of hours (e.g., 8-10 hours). Note that a structure formed of a solid mass can have voids therein and still be "solid" (i.e., rigid and retaining a consistent shape and volume, as opposed to a flowable material, such as a liquid, gas, granular or particulate material).

When the sleeve 42 is shifted upward, the fluid 40 can enter the passage 44 and contact the degradable material 32. When degraded, the material 32 will no longer radially outwardly support the seal element 24. In the case of the degradable material 32 comprising sodium and/or potassium, contact with the fluid 40 could result in a reaction violent enough to cause destruction of, or at least damage to, the seal element 24.

Figure 3:
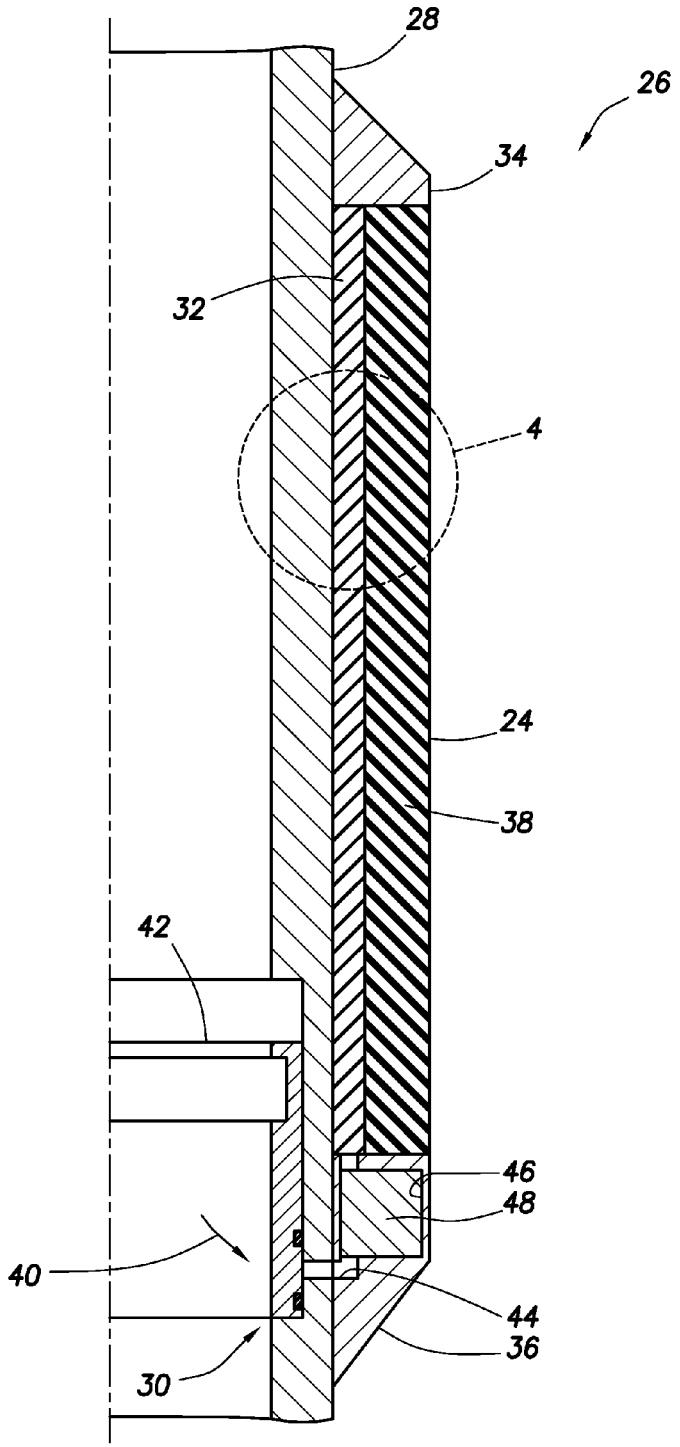
FIG. 3 is a schematic cross-sectional view of another configuration of the packer.

Referring additionally now to FIG. 3, another configuration of the packer 26 is representatively illustrated. The configuration of FIG. 3 is similar in many respects to the configuration of FIG. 2, but differs at least in that a chamber 46 is provided in one of the end rings 34, 36.

The chamber 46 can be used to contain an oxygen isolator 48, during storage of the packer 26, in order to prevent premature oxidation of the degradable material 32. A suitable oxygen isolator 48 could be an oxygen-free fluid, such as ethanol, or an oxygen scavenger.

In this manner, the degradable material 32 will not oxidize until the valve 30 is opened. Of course, if the degradable material 32 does not degrade by oxidation, then the oxygen isolator 48 may not be used.

Figure 4A:
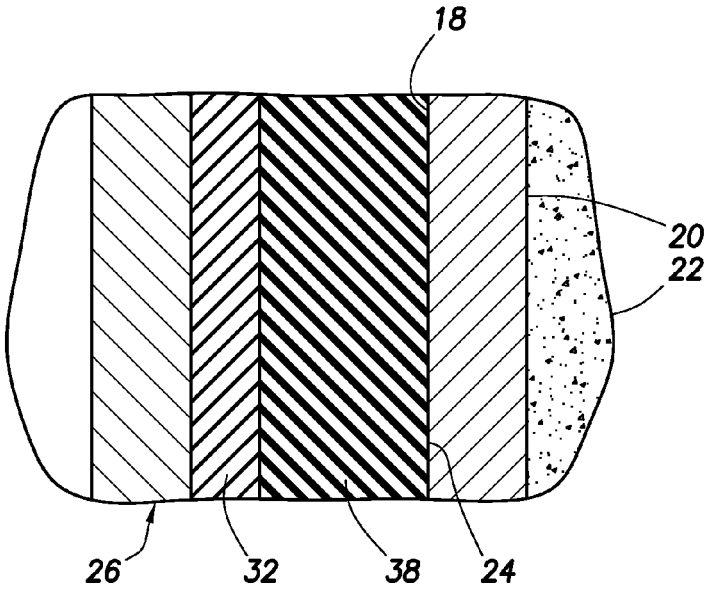
FIGS. 4A & B are enlarged scale schematic cross-sectional views of the packer set and unset in a well, respectively.

Referring additionally now to FIGS. 4A & B, the degradable material 32 is depicted respectively supporting the seal element 24, and not supporting the seal element. In FIG. 4A, the swellable material 38 has swollen, so that the seal element 24 has sealingly and grippingly engaged the wellbore 18. The degradable material 32 radially outwardly supports the swellable material 38, thereby allowing application of sealing and gripping forces from the seal element 24 to seal off the annulus 14 (see FIG. 1).

Figure 4B:
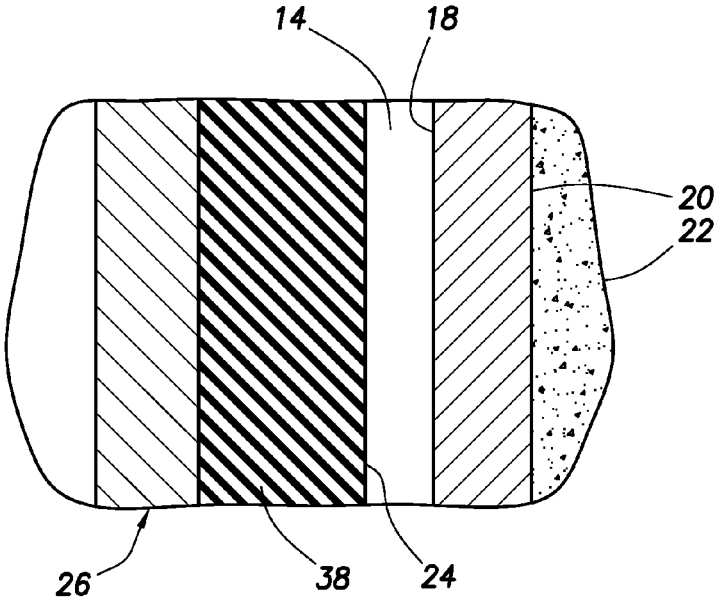

In FIG. 4B, the degradable material 32 has been degraded (e.g., by opening the valve 30 described above, etc.), thereby unsupporting the seal element 24. As depicted in FIG. 4B, the seal element 24 no longer applies sealing and gripping forces to the wellbore 18, or at least those forces are significantly reduced by the lack of support. FIG. 4B illustrates a lack of contact between the seal element 24 and the wellbore, but in other illustrations the seal element could continue to completely or partially contact the wellbore.

The degradable material 32 no longer radially outwardly supports the seal element 24 or its swellable material 38, thereby allowing for convenient retrieval of the packer 26 from the well. Thus, the packer 26 is readily unset, even though its swellable material 38 had previously been swollen in the well.

The packer 26 configurations described above are a few examples of a well tool which can be repeatedly actuated using swellable materials and degradable materials. In other examples, well tools (such as valves, hangers, samplers, completion equipment, etc.) can be actuated in a variety of ways. For example, valves can be opened and closed, latches can be engaged and disengaged, etc. Therefore, it will be appreciated by those skilled in the art, that the principles of this disclosure are not limited in any way to the details of the packer 26 described above.

The above disclosure provides to the art a unique way of actuating a well tool and, in particular, describes examples of a packer which can be set in a well by swelling a seal element material, and which can then be unset by degrading a material which had previously supported the seal element material. This allows for convenient retrieval of the packer from the well.

In one example, this disclosure describes a well tool 12 which includes a swellable material 38 and a degradable material 32 which supports the swellable material 38. The degradable material 32 degrades in response to contact with a selected fluid 40 in a well.

The swellable material 38 may be included in a seal element 24. The degradable material 32 can be positioned between the swellable material 38 and a generally tubular mandrel 28. The swellable material 38 may increase in volume in the well.

The fluid 40 may comprise water.

The degradable material 32 may comprise an anhydrous boron compound, sodium, potassium, and/or an oxygen source. The oxygen source can comprise peroxide.

Also described by the above disclosure is a method of unsetting a packer 26 in a subterranean well. The method can include, after the packer 26 has been set in the well, exposing a degradable material 32 of the packer 26 to a selected fluid 40, thereby degrading the degradable material 32. A seal element 24 of the packer 26 may be unsupported by the degradable material 32 in response to the exposing step.

A gripping force exerted by the seal element 24 on a structure (such as wellbore 18) in the well can be reduced in response to the exposing step. The seal element 24 may comprise a swellable material 38 which is swollen in the exposing step.

The above disclosure also provides to the art a packer 26 for use in a subterranean well. The packer 26 can include a swellable material 38 and a degradable material 32 which supports the swellable material 38.

The swellable material 38 may be included in a seal element 24 of the packer 26. The degradable material 32 can be positioned between the swellable material 38 and a generally tubular mandrel 28 of the packer 26.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," etc., are used for convenience in referring to the accompanying drawings.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A well tool, comprising:

a swellable material; and a degradable material which radially outwardly supports the swellable material, but which degrades in response to contact with a selected fluid in a well via a non-degradable passage through a wall of the well tool.

2. The well tool of claim 1, wherein the swellable material is included in a seal element.

3. The well tool of claim 1, wherein the degradable material is positioned between the swellable material and a generally tubular mandrel.

4. The well tool of claim 1, wherein the swellable material increases in volume in the well.

5. The well tool of claim 1, wherein the fluid comprises water.

6. The well tool of claim 1, wherein the degradable material comprises sodium.

7. The well tool of claim 1, wherein the degradable material comprises potassium.

8. The well tool of claim 1, wherein the degradable material comprises an oxygen source.

9. The well tool of claim 8, wherein the oxygen source comprises peroxide.

10. The well tool of claim 1, wherein the degradable material comprises an anhydrous boron compound.

11. A packer for use in a subterranean well, the packer comprising:

a swellable material;

a degradable material which radially outwardly supports the swellable material; and a non-degradable passage for fluid to contact the degradable material disposed in a wall of the packer.

12. The packer of claim 11, wherein the swellable material is included in a seal element of the packer.

13. The packer of claim 11, wherein the degradable material is positioned between the swellable material and a generally tubular mandrel of the packer.

14. The packer of claim 11, wherein the degradable material degrades in response to contact with a selected fluid in the well.

15. The packer of claim 14, wherein the fluid comprises water.

16. The packer of claim 11, wherein the degradable material comprises sodium.

17. The packer of claim 11, wherein the degradable material comprises potassium.

18. The packer of claim 11, wherein the degradable material comprises an oxygen source.

19. The packer of claim 18, wherein the oxygen source comprises peroxide.

20. The packer of claim 11, wherein the degradable material comprises an anhydrous boron compound.

* * * * *